US006772134B1

(12) United States Patent
Jacubasch et al.

(10) Patent No.: US 6,772,134 B1
(45) Date of Patent: Aug. 3, 2004

(54) CONTROL MEANS FOR A HORIZONTAL BORING TOOL

(75) Inventors: Andreas Jacubasch, Karlsruhe (DE); Helge Bjorn Kuntze, Stutensee (DE); Hans-Joachim Bayer, Ettlingen (DE)

(73) Assignee: Fraunhofer Gesellschaft zur Forderung der angewandten Forschung, e.V., Munich (DE)

( * ) Notice: Subject to any disclaimer, the term of this patent is extended or adjusted under 35 U.S.C. 154(b) by 0 days.

(21) Appl. No.: 09/787,732

(22) PCT Filed: Aug. 31, 1999

(86) PCT No.: PCT/DE99/02797

§ 371 (c)(1),
(2), (4) Date: Mar. 22, 2001

(87) PCT Pub. No.: WO00/17487

PCT Pub. Date: Mar. 30, 2000

(30) Foreign Application Priority Data

Sep. 23, 1998 (DE) ..... 198 43 639

(51) Int. Cl.[7] ..... G06F 15/18; G06G 7/00

(52) U.S. Cl. ..... 706/8; 706/2; 706/904; 706/900; 706/912; 706/928; 700/49; 700/50; 700/51; 175/40; 175/45; 324/326; 324/328; 324/226; 324/247; 299/1.5; 299/1.8; 299/55; 299/74; 405/138; 405/143

(58) Field of Search ..... 706/1, 2, 8, 900, 706/904, 912, 928; 700/50, 51, 49; 324/326, 327, 328, 329, 226, 247; 175/40, 45; 299/1.5, 1.8, 1.3, 1.1, 2, 55, 74, 77; 405/138, 143

(56) References Cited

U.S. PATENT DOCUMENTS 4,858,704 A * 8/1989 McDonald et al. ..... 175/61
5,312,163 A * 5/1994 Hanamoto et al. ..... 299/1.8
5,553,680 A * 9/1996 Hathaway ..... 175/78
5,990,682 A * 11/1999 Mercer ..... 324/326
6,057,687 A * 5/2000 Mercer ..... 324/326
6,525,538 B1 * 2/2003 Mercer ..... 324/326
6,593,745 B2 * 7/2003 Mercer ..... 324/326

FOREIGN PATENT DOCUMENTS

EP 0 598 139 A1 5/1994
WO WO 97/31175 8/1997

OTHER PUBLICATIONS

Kuntze, H.–B: "Regelungsalgorithmen fur rechnergesteuerte Industrieroboter", Regelungstechnik 33, (1984), vol. 5, pp. 215–226.

(List continued on next page.)

*Primary Examiner*—Ramesh Patel
(74) *Attorney, Agent, or Firm*—Breiner & Breiner, L.L.C.

(57) ABSTRACT

Control apparatus for a horizontal boring tool is described which drives a boring lance via boring rods. The tool includes an input interface for receiving actual values of controlled variables of the horizontal boring tool, and an output unit for issuing control signals for controlling the horizontal boring tool. Between the input interface and the output unit is provided a fuzzy control unit which determines the control signals for activation of the horizontal boring tool from the actual values of the controlled variables and the desired values for the controlled variables by fuzzy logic while taking into account heuristic process values. The control apparatus permits automatic operation of the horizontal boring tool with good course steering and high precision.

17 Claims, 3 Drawing Sheets

OTHER PUBLICATIONS

Kuntze, H.–B: "Position control of Industrial robots–impacts, concepts and results", Proc. 2nd IFAC–Symposium on Robot Control "SYROCO '88", Karlsruhe, Oct. 5–7 (1988) (9 pages).

Altrock, C.v.: "Fuzzy–Logic in der Sensorik" SENSOR report, (1991), vol. 4, pp. 39–42.

Sajidman, M. and H.–B. Kuntze: "Integration of Fuzzy Control and Model Based Concepts for Disturbed Industrial Plants with Large Dead–Times", Proceedings of the sixth IEEE Int. Conf. on Fuzzy Systems (FUZZ IEEE '97), Barcelona (Spain), Jul. 1–5 (1997), pp. 1007–1013.

Kuntze, H.–B.: M. Sajidman and A. Jacubasch: "A Fuzzy-Logic concept for highly fast and accurate position control of industrial robots" Proc. 1995 IEEE Int. Conf. on Robotics and Automation ICR '95, Nagoya (Japan), May 21–27, (1995), paper WPII–10.4, pp. 1–15.

Kuntze, H.B.: "Einsatzmoglichkeiten von Fuzzy–Logic bei der ProzeBautomatisierung", FhG–IITB–Mitteilungen, (1992), pp. 14–21.

* cited by examiner

CONTROL MEANS FOR A HORIZONTAL BORING TOOL

The present invention relates to a control means for a horizontal boring tool according to the generic part of claim 1 and to a process for controlling such a horizontal boring tool.

In conventional underground engineering technology, laying new pipes for gas, liquids or electric lines involves considerable costs and environmental concerns. This is particularly the case when laying lines running under streets, rivers or buildings. These high costs stem from both the primary costs of the required building measures as well as from the follow-up costs of disrupting traffic or other hindrances in the respective area. Ditchless laying methods can reduce such costs and environmental concerns considerably. Therefore, various boring techniques have been employed which avoid opening surface of the earth.

The present invention relates to horizontal boring processes as, for instance, are known from H.-J. Bayer's, "Prinzipien des steuerbaren Horizontal-Spulbohrverfahrens", 3R international, Vol. 30 (1991), No. 9, pp. 511–517. In these horizontal boring processes, a cylindrical, hollow boring head, from which a rinsing fluid, for example bentonite, is pumped through nozzles, is pushed diagonally into the ground with the aid of a screwed together boring rods. Slanting of the boring head renders the boring head controllable not only regarding its feed rate respectively its thrust power but also regarding to the direction in which it moving. If the boring head is rotated evenly, it moves practically straight. If the boring head is not turned while advancing, it moves in a curved path whose direction is prescribed by the location of the incline. This design ensures the controllability of the boring head in every direction. The farther the boring head moves from the hydraulic control unit of the boring equipment, the more negatively the play and elasticity of the boring rods will influence the behavior of the system with regard to precision and stability.

In known state-of-the-art horizontal boring tools, the boring head respectively the boring lance is controlled via the advancement and the rotation of the boring rods by one person, the boring operator. The boring operator receives the information concerning the current position and location of the boring head from respective measuring sensors at the boring head. Horizontal boring tools are provided with a robust, high-resolution sensory mechanism, which continuously measures the orientation of the boring head with reference to a stationary coordinate system by measuring the roll angle, azimuth and inclination of the boring head. The respective current Cartesian position of the boring head can be determined from the current length of the boring rods in conjunction with the boring head's preceding change in angle. In addition to the position and orientation of the boring head, the load moment of the boring rods and the pressure of an introduced boring fluid can also be detected by the sensors.

The moving behavior of the boring head is very complicated and depends strongly on the boring head's momentary surroundings, in particular the consistency, structural constitution and the density of the earth material. Such complexity demands high boring quality and great skill on the part of the boring operator. Bore quality means here the precise as possible adherence to the prescribed boring course while avoiding collisions. The boring operator has to deduce, as necessary, correction of the rate of advancing, the rotation and the angle of rotation from the respective current orientation and position values transmitted by the sensors as well as take into account the respective momentary behavior of the boring head in the corrections. Consequently, proper operation of such a horizontal boring tool requires long training and much experience regarding the different underground behavior of the boring tool. The quality of the boring is, therefore, to a great degree dependent on the respective individual assigned as the boring operator and, furthermore, is subject to fluctuations due to tiredness. Thus, there is an increasing need for automation of the control process of a horizontal boring tool.

However, due to the great complexity of the boring procedure, it has hitherto not been possible to find suited control algorithms for a control means for such a horizontal boring tool.

The object of the present invention is to provide a control means for a horizontal boring tool as well as a process for controlling the horizontal boring tool, which automatically keeps the boring head as precisely as possible on the programmed course and reaches the target as precisely as possible independent of fluctuations in the earth consistency without any action of an experienced boring operator. Moreover, the boring procedure should require as little time as possible.

The object is solved by means of a control means according to claim 1 respectively by means of a process according to claim 10. Advantageous embodiments of the control means and of the process are the subject matter of the subclaims.

The invented control means for a horizontal boring tool is provided with an input interface for receiving the actual values of the controlled variables of the horizontal boring tool. Such controlled variables can, for example, be the roll angle, inclination and azimuth of the boring head as well as the current position of the boring head determined from these values and the rate of advancing. Furthermore, an output unit is provided which issues the control signals for steering the horizontal boring tool. Between the input interface and the output unit is a fuzzy control unit which determines the control signals by means of fuzzy logic from the actual values and the desired values for the controlled variables while taking into account heuristic process values. The heuristic process values are based, for example, on a bore operator's long experience and comprise an engineer's description of the movement behavior of the boring head from not exactly determined "if—then" relationships for linking the actual values and the desired values with the corresponding control signals. In this way, know-how gathered over the years from controlling the boring heads manually can be translated into automatic control, which is especially advantageous in the present case of a control means for a horizontal boring head, because, due to the diversity of possible influences, the behavior of the boring head cannot be described physico-analytically with dynamic models.

The actual values of the controlled variables are measured by the sensors, which are provided on the boring head respectively the boring lance. Further sensors may, for example, be provided on the boring rods for determining the advancement and the angle of rotation or the rotation velocity of the rod assembly.

In the invented process, the actual values of the controlled variables of the horizontal boring tool are measured, the control signals for steering the horizontal boring tool are determined from the actual values and the desired values for the controlled variables by means of fuzzy logic while taking into account the heuristic process values, and the horizontal boring tool is steered by the control signals.

The invented control means for a horizontal boring tool and the process for controlling the horizontal boring tool permits conducting the boring procedure automatically with great aiming precision. The boring head can be made to closely adhere to a preprogrammed course independent of any fluctuations in the ground properties. The control means, therefore, permits conducting the boring procedure without employing an experienced boring operator. Fluctuations in boring speed and boring precision due to tiring are obviated. Consequently, the boring procedure can be finished faster.

The efficiency of the invented control means has already been proven in test borings.

In an advantageous embodiment of the invented control means respectively of the invented process, unlike in other fuzzy-control systems, the actual value is itself not subject to fuzzy control, but rather the variance between the actual value and the desired value.

In another advantageous embodiment, an optimizing tool based on a neuronal network (NN) is employed. In this approach, a NN learning component supplements the optimizing fuzzy control unit. This NN learning component comprises an adaptable NN model of the fuzzy control unit and a NN model of the control circuit. In a training phase preceding automatic operation, the NN control model is trained using representative training trajectories, for example using the desired trajectories until the model-actual trajectory cannot be improved regarding a selectable quality index. The optimized fuzzy parameters are now stored in the control hardware. Then automatic operation, that is automatic control and steering for the horizontal boring tool, can commence.

The control means for the horizontal boring tool is preferably realized by a digital signal processor (DSP), in which the fuzzy control unit is implemented. This DSP is preferably coupled to a PC via which the respective parameters can be entered.

The control means for the horizontal boring tool and the process for controlling the tool are described again in the following using a preferred embodiment without the intention of limiting the scope or spirit of the inventive idea, whereby:

Figure 1:
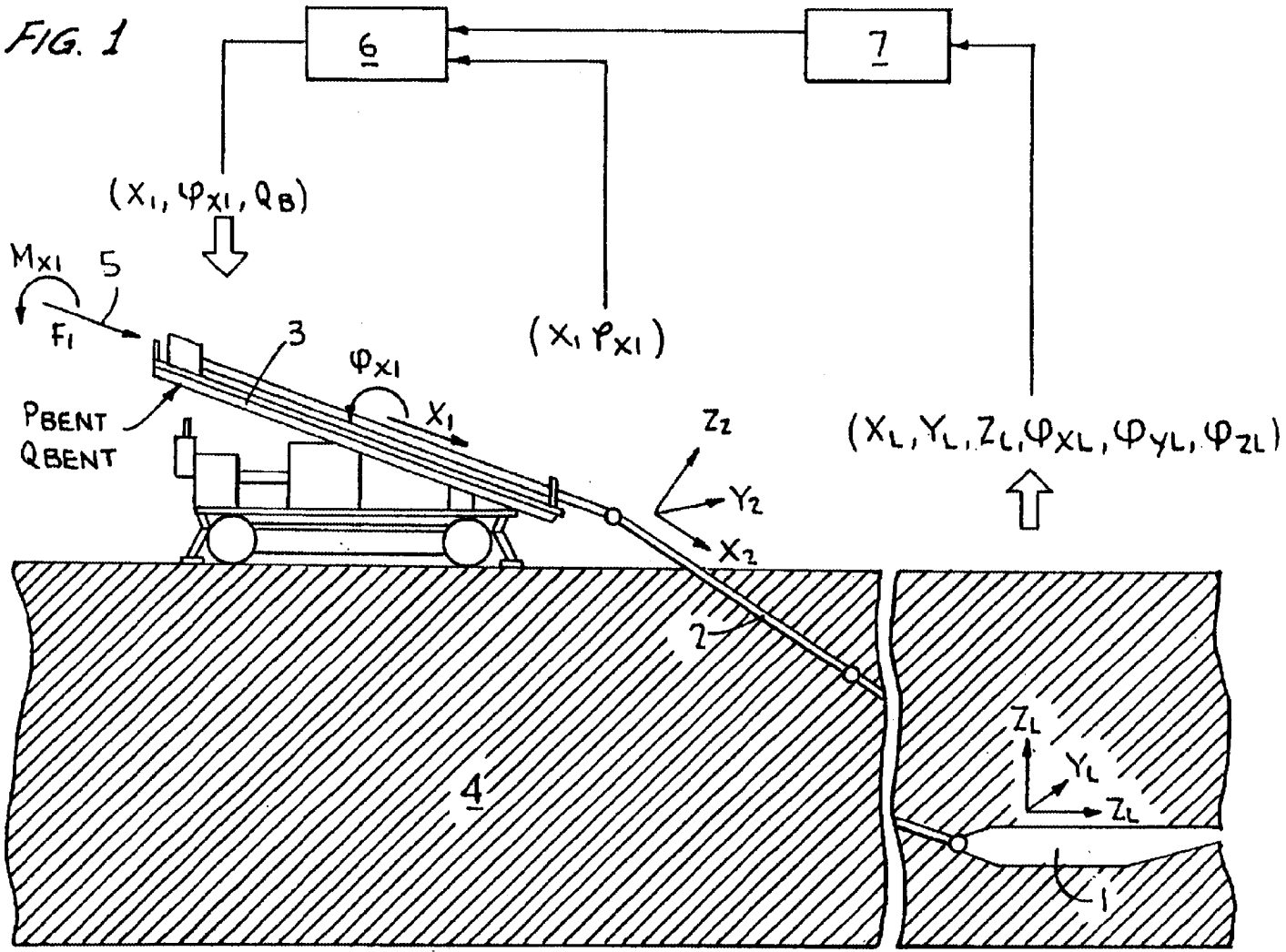
FIG. 1 shows a diagram of a course regulation of a horizontal boring tool using the respective control and state variables.

In the present example, the control means for a horizontal boring system shown in FIG. 1 is made more apparent. The horizontal boring system comprises a boring lance 1 having a navigation sensor as well as boring rods 2 to which the boring lance is attached. The boring rods are driven via a so-called rig 3. Reference number 4 stands for the ground area in which the boring is to be conducted. The horizontal boring system is steered via the fuzzy course control 7 supplemented by an additional servocontrol 6.

The horizontal boring tool utilized in this example is equipped with a rig exercising a tensile force of 120 kN on the advancement axis 5. In the advancing of the boring, the boring rods 2 are steered by the boring lance 1 at the tip with the aid of the rig. The boring rods 2 can be rotated about its longitudinal axis can be advanced transitorily. These two degrees of freedom can be controlled independently of one another and permit steering the advancing of the boring selectively along a set desired line.

In the present example, the boring lance 1 is provided with an asymmetrically shaped boring tip designed like an asymmetrical wedge, thereby selectively influencing the course of the boring. Furthermore, the exit nozzles for the boring fluid, for example bentonite, can be disposed asymmetrically on the boring lance in such a manner that non-symmetric loosening of the ground is permitted directly before the boring lance.

Figure 2:
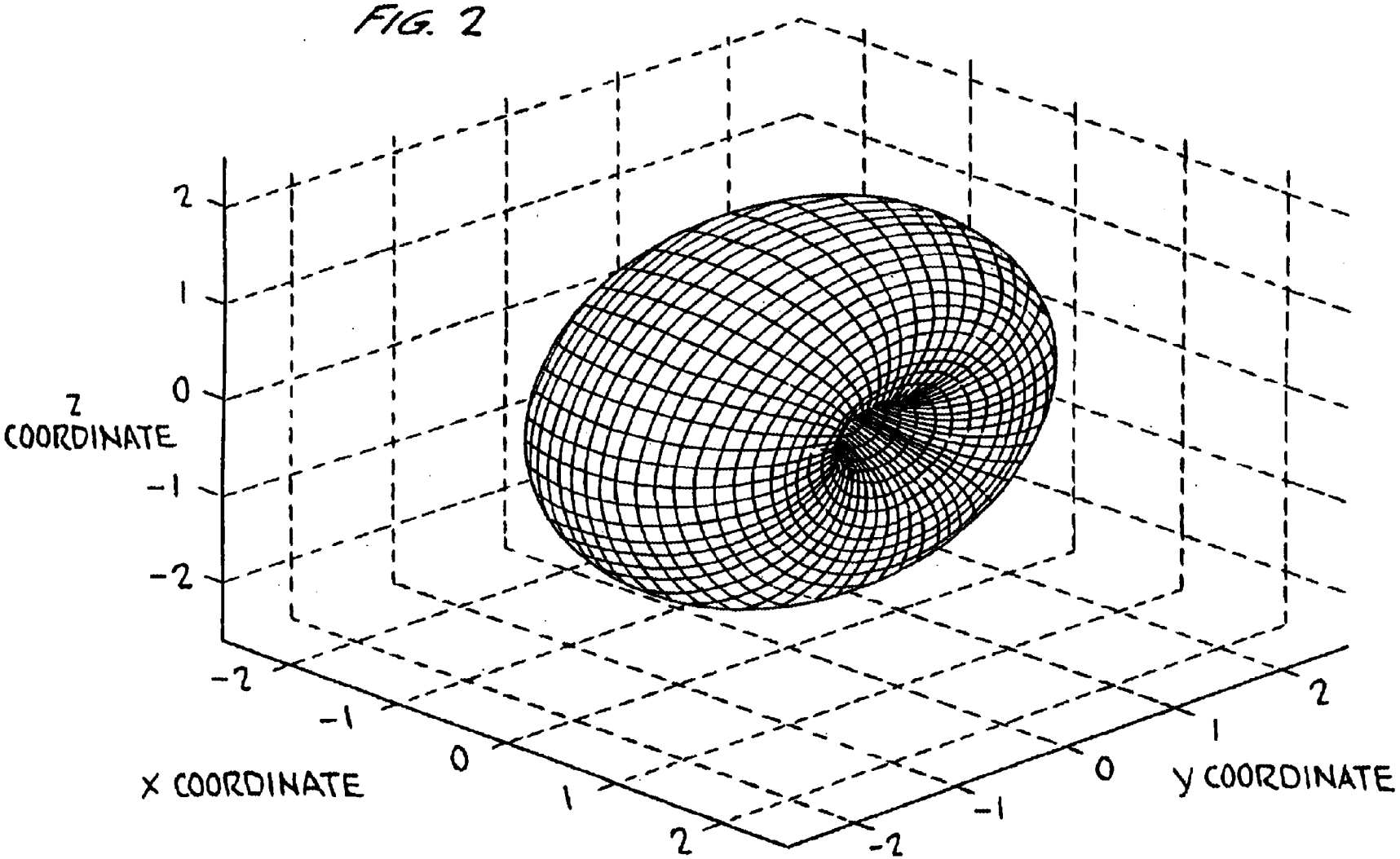
FIG. 2 shows a three-dimensional view of the steering space of a boring lace in dependence on the roll angle.

The horizontal boring tool equipped in this manner, if no additional interfering influences from the ground are encountered, has two modes of steering. Boring advancement runs practically straight if the boring rods are advanced rotatingly. If the boring rods are advanced without rotating, boring advancement runs practically circularly. The momentary circular path of the boring course depends in the first approximation only on the set, stationary roll angle of the boring lance 1, which represents a very important process variable. The steering space of the boring lance is shown three-dimensionally in FIG. 2 for all possible roll angles. Mathematically, this yields a torus with an internal radius of approximately 0 and an exterior radius ranging from between 10 to 160 m. This external radius is dependent on the physical ground parameters, the boring rods material, the mechanical form of the boring lance and the set boring process parameters at the horizontal boring tool.

Rotation and advancement of the boring rods 2 occurs with the aid of hydraulic cylinders for the advancement and a hydraulic motor for the rotation. The oil flow for the hydraulic is produced using a central pressure pump. The oil flow for the individual hydraulic circuits is electrically operated by remote control by means of mechanical levers via proportional valves with electrical activation of electronics. The proportional valves have the property that they impress the oil flow independent of the attacking interfering forces and therefore set the velocity of the respective hydraulic circuit proportional to the valve setting. The same applies for the flow of the boring fluid which is set by means of a hydraulic motor and a pump motor. The boring rinsing fluid is supplied via a supply transport vehicle. The actuators of the system are three independently settable hydraulic proportional valves which can be set manually as well as electrically (via electromagnetic components). Activation of the valves occurs in the present example via an analog interface card in the control. The hydraulic valves can also be operated manually.

Monitoring and measuring the diverse system conditions occurs using sensors. Thus a navigation sensor with a length of approximately 3 m and a weight of approximately 50–100 kg is mounted on the boring lance which supplies the three angle values $\Phi_{xL}$ (roll angle of the lance), $\Phi_{yL}$ (azimuth angle of the lance) and $\Phi_{zL}$ inclination angle of the lance) in a fixed world coordinate system ($x_L$, $y_L$, $z_L$). Advancement of the, also measured, three-dimensional course of the boring lance values can be computed in x-, y-, z- world coordinates from these three angle values. Furthermore, two angle encoders are provided for determining the position of the advancement ($x_1$) and of the roll angle ($\Phi_{x1}$) on the rig. The hydraulic pressures for advancement and rotation as well as the bentonite pressure of the boring rinsing fluid are detected by three pressure sensors. A revolution counter (frequency measurement) serves to measure the revolution velocity of the bentonite hydraulic motor.

FIG. 1 also shows other physical measurement values, which, if need be, can be determined and included in the control. This affects, in particular, the setting of the bentonite mass flow $Q_B$ and the pressure of the bentonite/water suspension $P_B$. Furthermore, the torque $M_{x1}$ of the boring rods can be detected.

Preferable control variables are the translational path of the thrust cylinder (x1), the angle setting of the torque motor for the boring rods (($\Phi_{x1}$) and the volume flow of the bentonite/water suspension ($Q_B$).

Figure 3:
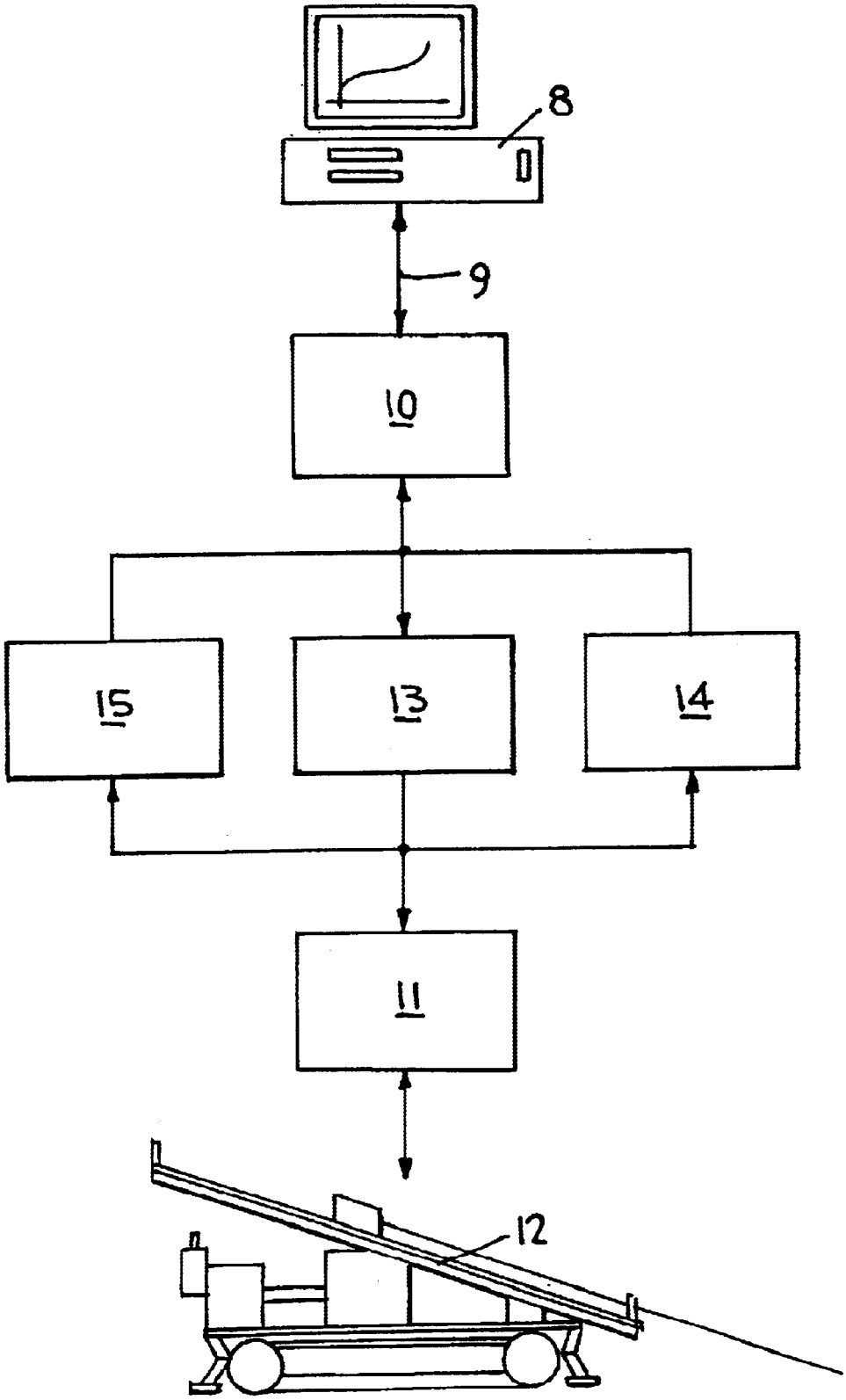
FIG. 3 a diagram of an example of the components of a control means for a horizontal boring tool.

FIG. 3 shows an example of the structure of the control means of the presented horizontal boring tool for automatic course control of the boring course. The fuzzy control concept is implemented on a PC 8 in conjunction with a rapid signal processor 10, which is coupled on the sensor and control side with the horizontal boring tool. For coupling, a hardware and software matching interface is created. The control means thus comprises a standard PC 8 with the appropriate software for operating and monitoring the boring process. The heart of the control means is a digital signal processor system (DSP) 10, which is connected to the PC 8 by PC bus 9. DSP 10 assumes the control of the boring process. The purpose of a hardware interface 11 having a connecting cable and distribution box 12 is the bidirectional exchange of data between the digital control means and the horizontal boring system. Furthermore, the control means comprises a D/A transducer 13, an A/D transducer 14 and a counter card 15. The actuators described in the preceding, that is the hydraulic proportional valves for controlling the rate of advancing of the lance, the lance roll angle and the bentonite flow are actuated via the hardware interface 11. In this case, an additional servocontrol is provided.

What is claimed is:

1. A horizontal boring tool, for driving a boring lance via boring rods, said boring lance having an asymmetrically slanted hollow boring head with nozzles for a rinsing fluid, said boring head moving on a straight line when said boring rods are advanced rotatingly and said boring head moving on a curved line when said boring rods are advanced without rotating, an orientation of said curved line being determined by an actual roll angle $\Phi_{xL}$ of the boring lance, said horizontal boring tool comprising a control means provided with an input interface for receiving actual values of controlled variables of said horizontal boring tool, and an output unit for issuing control signals for controlling said horizontal boring tool, said controlled variables including said roll angle $\Phi_{xL}$, an azimuth angle $\Phi_{yL}$ and an inclination angle $\Phi_{zL}$ of said boring lance, wherein between said input interface and said output unit, a fuzzy control unit is provided which determines said control signals for controlling at least an advancement of the boring rods and an angle setting $\Phi_{x1}$ of torque motor for the boring rods of said horizontal boring tool from the actual values of the controlled variables and desired values for the controlled variables by means of fuzzy logic while taking into account heuristic process values.

2. A horizontal boring tool according to claim 1, wherein said fuzzy control unit provides variance between said desired values and said actual values to fuzzy control and determines therefrom said control signals.

3. A horizontal boring tool according to claim 1, wherein said control variables include orientation and/or position of said boring lance.

4. A horizontal boring tool according to claim 1, wherein said control variables include rate of advancement and/or torque of said boring rods.

5. A horizontal boring tool according to claim 4, wherein said control variables include flow volume and/or pressure of a boring fluid conveyed to said boring lance.

6. A horizontal boring tool according to claim 1, wherein an optimization tool is provided for said fuzzy control unit while utilizing a neuronal network.

7. A horizontal boring tool according to claim 6, wherein said optimization tool contains software for a training phase of said fuzzy control unit.

8. A horizontal boring tool according to claim 1, further comprising a desired value setter which provides dynamic desired values relating to a temporal course of a boring procedure which is provided.

9. A horizontal boring tool according to claim 1, wherein said fuzzy control unit includes a digital signal processor.

10. A process for controlling a horizontal boring tool which drives a boring lance via boring rods, said boring lance having an symmetrically slanted hollow boring head with nozzles for a rinsing fluid, said process comprising moving said boring head on a straight line when said boring rods are advanced rotatingly and moving said boring head on a curved line when said boring rods are advanced without rotating, and determining an orientation of said curved line by an actual roll angle $\Phi_{xL}$ of the boring lance, measuring actual values of controlled variables of said boring tool, said control variables including said roll angle $\Phi_{xL}$, an azimuth angle $\Phi_{yL}$ and an inclination angle of $\Phi_{zL}$ of said boring lance, determining control signals for controlling at least an advancement of the boring rods and an angle setting $\Phi_{x1}$ of torque motor for the boring rods of said horizontal boring tool from said actual values of said controlled variables and desired values for said controlled variables by means of fuzzy logic while taking into account heuristic process values, and activating said horizontal boring tool with said control signals.

11. A process according to claim 10 wherein variance between said desired values and said actual values are subjected to fuzzy control and said control signals are determined therefrom.

12. A process according to claim 10 wherein said controlled variables include orientation and/or position of said boring lance.

13. A process according to claim 10 wherein said controlled variables include rate of advancement and/or torque of said boring rods.

14. A process according to claim 13 wherein said controlled variables include flow volume and/or pressure of a boring fluid conveyed to said boring lance.

15. A process according to claim 10 wherein said fuzzy control unit is optimized prior to initial activation of said horizontal boring tool while utilizing a model of a neuronal network.

16. A process according to claim 10 wherein dynamic desired values concerning a temporal course of a boring procedure is given as said desired values.

17. A process according to claim 10, wherein advancement and/or rotation of said boring rods and/or flow of an introduced boring fluid is controlled using said control signals.

* * * * *